US010808734B2

(12) United States Patent
Zeller et al.

(10) Patent No.: US 10,808,734 B2
(45) Date of Patent: Oct. 20, 2020

(54) APPARATUS FOR CONTROLLING A HYDRAULIC MACHINE

(71) Applicant: VOITH PATENT GMBH, Heidenheim (DE)

(72) Inventors: Thomas Zeller, Aalen (DE); Rouven Hohage, Buxheim (DE)

(73) Assignee: Voith Patent GmbH, Heidenheim (DE)

( * ) Notice: Subject to any disclaimer, the term of this patent is extended or adjusted under 35 U.S.C. 154(b) by 0 days.

(21) Appl. No.: 16/497,182

(22) PCT Filed: Feb. 8, 2018

(86) PCT No.: PCT/EP2018/053139

§ 371 (c)(1),
(2) Date: Sep. 24, 2019

(87) PCT Pub. No.: WO2018/177640

PCT Pub. Date: Oct. 4, 2018

(65) Prior Publication Data

US 2020/0018329 A1 Jan. 16, 2020

(30) Foreign Application Priority Data

Mar. 29, 2017 (DE) ..... 10 2017 106 693

(51) Int. Cl.
*F15B 11/17* (2006.01)
*F15B 11/00* (2006.01)
(Continued)

(52) U.S. Cl.
CPC ..... *F15B 11/17* (2013.01); *F15B 1/022* (2013.01); *F15B 11/003* (2013.01); *F15B 20/00* (2013.01); *F15B 2211/20515* (2013.01); *F15B 2211/20546* (2013.01); *F15B 2211/20561* (2013.01); *F15B 2211/20576* (2013.01); *F15B 2211/212* (2013.01); *F15B 2211/27* (2013.01); *F15B 2211/3057* (2013.01);
(Continued)

(58) Field of Classification Search
CPC ..... F15B 1/022; F15B 11/003; F15B 11/17; F15B 13/015; F15B 20/00
See application file for complete search history.

(56) References Cited

U.S. PATENT DOCUMENTS 4,111,101 A 9/1978 Obiya et al.
6,625,982 B2 * 9/2003 Van Den Bossche .... F15B 7/00 60/403
(Continued)

FOREIGN PATENT DOCUMENTS

DE 2713867 A1 10/1977
DE 102010053811 A1 6/2012
(Continued)

*Primary Examiner* — Michael Leslie
(74) *Attorney, Agent, or Firm* — Laurence A. Greenberg; Werner H. Stemer; Ralph E. Locher

(57) ABSTRACT

An apparatus for controlling a hydraulic machine, for example a turbine, pump or pump turbine, using variable-speed driven fixed displacement pumps. The apparatus includes a device for carrying out an emergency shut-off that is characterized by low energy consumption and high efficiency while guaranteeing all the operation-relevant and safety-relevant requirements of a hydraulic machine.

8 Claims, 1 Drawing Sheet

(51) Int. Cl.
*F15B 1/02* (2006.01)
*F15B 20/00* (2006.01)

(52) U.S. Cl.
CPC ..... *F15B 2211/30515* (2013.01); *F15B 2211/322* (2013.01); *F15B 2211/40507* (2013.01); *F15B 2211/41572* (2013.01); *F15B 2211/625* (2013.01); *F15B 2211/6355* (2013.01); *F15B 2211/8752* (2013.01); *F15B 2211/8755* (2013.01)

(56) References Cited

U.S. PATENT DOCUMENTS

| | | | | |
|---|---|---|---|---|
| 7,493,757 | B2 * | 2/2009 | Kurz | F15B 7/001 60/430 |
| 7,546,730 | B2 * | 6/2009 | Kubinski | E02F 9/085 60/430 |
| 9,239,064 | B2 * | 1/2016 | Helbig | F15B 20/002 |
| 9,709,076 | B2 * | 7/2017 | Akiyama | F15B 11/17 |
| 9,850,916 | B2 | 12/2017 | Helbig et al. | |
| 2019/0315456 | A1 * | 10/2019 | Fox | F15B 11/17 |
| 2020/0096015 | A1 * | 3/2020 | Zeller | F15B 11/17 |

FOREIGN PATENT DOCUMENTS

| | | | |
|---|---|---|---|
| DE | 102013212937 | A1 | 7/2014 |
| DE | 102013008047 | A1 | 11/2014 |
| WO | 0204820 | A1 | 1/2002 |
| WO | 2014183941 | A1 | 11/2014 |

* cited by examiner

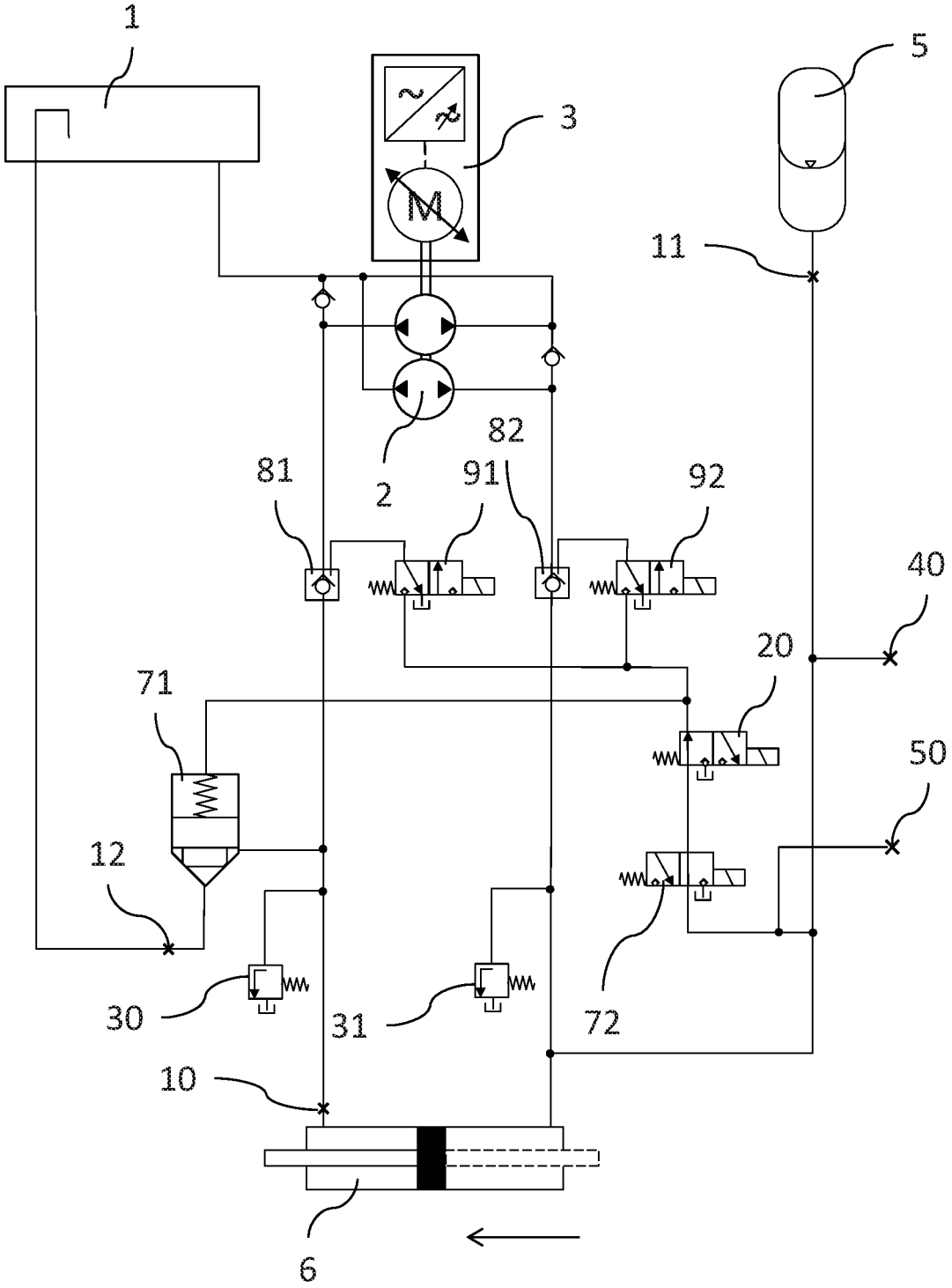
1
3
M
5
11
2
82
81
91
92
40
20
71
50
12
30
31
72
10
6

APPARATUS FOR CONTROLLING A HYDRAULIC MACHINE

BACKGROUND OF THE INVENTION

Field of the Invention

The invention relates to an apparatus for controlling a hydraulic machine, and in particular to an apparatus for controlling a turbine, a pump or a pump turbine.

Conventional apparatuses for controlling a hydraulic machine are known from the general prior art. For example, DE 27 13 867 A1 describes one such apparatus (see FIG. 3), which comprises a pressure oil source, a hydraulic servo motor (hydraulic cylinder) and control valves for metering the energy to adjust the hydraulic cylinder. As a rule, the pressure oil source is an reservoir for the hydraulic medium under overpressure. The reservoir must be filled, and brought to and kept at the required working pressure, with the aid of pumps.

An apparatus for opening and closing the guide vanes of a hydraulic machine is also known from DE 10 2013 212 937 A1, in which variable-speed hydraulic fixed displacement pumps are used. In this document, only the fundamental mode of operation of such an apparatus is disclosed.

SUMMARY OF THE INVENTION

The object of the present invention is to provide an apparatus for controlling a hydraulic machine in which variable speed hydraulic fixed displacement pumps are used, and which ensures the requirements of a hydraulic machine are met, for example with regard to actuating times, emergency closing properties—even in the event of pump failure, suitability for large hydraulic cylinder volumes, etc. Compared to conventional apparatus, the solution according to the invention is characterized by high energy efficiency, good environmental compatibility, ease of maintenance and low acquisition and operating costs.

According to the invention, this object is accomplished by an apparatus for controlling a hydraulic machine as claimed. Further advantageous configurations of the apparatus according to the invention are set forth in the dependent claims that depend therefrom.

The solution according to the invention is explained below with reference to the drawings. The drawings illustrate the following, specifically:

BRIEF DESCRIPTION OF THE DRAWING

The FIGURE shows a schematic structure of an apparatus according to the invention DESCRIPTION OF THE INVENTION The FIGURE shows a schematic representation of an apparatus for controlling a hydraulic machine according to the invention. The apparatus comprises a collection and equalizing tank marked 1, a pump assembly marked 2, a variable speed pump drive marked 3, a reservoir marked 5, a hydraulic cylinder marked 6, an emergency shut-off valve marked 71, an emergency shut-off solenoid valve marked 72, two unlockable check valves marked 81 and 82, two pilot valves marked 91 and 92, three throttles marked 10, 11 and 12, an optional solenoid valve marked 20, two optional pressure relief valves marked 30 and 31, and two optional ports marked 40 and 50. The arrow below the hydraulic cylinder 6 indicates its closing direction.

The hydraulic cylinder 6 may, for example, be the guide wheel hydraulic cylinder or the hydraulic cylinder for adjusting the runner blades of a hydraulic machine. Such hydraulic cylinders often require large volumes of hydraulic fluid for operation. The hydraulic cylinder 6 may be designed as a synchronous cylinder, as indicated in the FIGURE by the dashed second rod. However, the hydraulic cylinder 6 may also be designed as a differential cylinder with different volumes for the closing and opening sides.

The pump assembly 2 comprises two pumps with a reversible pumping direction. In the FIGURE, the two pumps are arranged on a shaft that is driven by the pump drive 3. However, other structural configurations are also possible; for example, the pumps may be driven by the pump drive 3 by means of a gear. It is also conceivable that the pump drive 3 would respectively comprise a motor and a frequency converter for each of the two pumps. The further description refers to the embodiment shown in the FIGURE. One port of each pump is respectively connected to a control line of the hydraulic cylinder, so that in one direction of rotation of the shaft, one pump pumps hydraulic fluid in the direction of the hydraulic cylinder 6 and the other pump receives hydraulic fluid from the hydraulic cylinder 6. In the other direction of rotation of the shaft, the reverse is the case. In the FIGURE, the right port of the lower pump is connected (via the unlockable check valve 82) to the closing side of the hydraulic cylinder 6, and the left port of the upper pump is connected (via the unlockable check valve 81) to the opening side of hydraulic cylinder 6. The other ports of the pumps are respectively directly connected to the collection and equalizing tank 1. In other words, in one direction of rotation of the shaft the lower pump pumps hydraulic fluid from the collecting and equalizing tank 1 into the closing side of the hydraulic cylinder 6, and at the same time the upper pump pumps hydraulic fluid from the opening side of the hydraulic cylinder 6 into the collecting and equalizing tank 1. In the other direction of rotation of the shaft the volume flows are reversed. If the delivery volumes of the two pumps are the same, this means that ultimately no hydraulic fluid flows into or is withdrawn from the collecting and equalizing tank 1 (see below regarding the synchronous cylinder). In the other case, only the differential delivery of the pumps is transferred to or removed from the collecting and equalizing tank 1 (see below regarding the differential cylinder). It is assumed here that the respective check valves 81 and 82 are unlocked (see below in the description of the operating conditions).

If the pumps used have marked pressure and suction ports, the pressure ports should preferably always be connected to the hydraulic cylinder 6 and the suction ports to the collecting and equalizing tank 1.

The shaft of the pump assembly 2 is driven by the variable speed pump drive 3, which may be operated in both directions of rotation. The pump drive 3 usually comprises an electric servo motor that is electrically fed by a frequency converter.

The unlockable check valves 81 and 82, which are arranged in the connecting lines of the hydraulic cylinder 6 with the pump assembly 2 in such a way that they prevent movement of the piston of the hydraulic cylinder in the non-unlocked state, are respectively connected to one of the pilot valves 91, 92. These are respectively connected (via valves 20 and 72) to the reservoir 5. Opening a pilot valve 91, 92 thus causes the associated check valve 81, 82 to be unlocked. The (electric) controller of the hydraulic machine causes the pilot valves 91, 92 to open by energizing them. Each of the pilot valves 91, 92 may be energized separately.

The reservoir 5 is connected to the closing side of the hydraulic cylinder 6. The emergency shut-off valve 71 is connected to the opening side of the hydraulic cylinder 6 and the collecting and equalizing tank 1 in such a way that a volume flow between the opening side of the hydraulic cylinder 6 and the collecting and equalizing tank 1 is only possible when the emergency shut-off valve 71 is open. The emergency shut-off solenoid valve 72, which is located in a hydraulic line between the emergency shut-off valve 71 and the reservoir 5, controls the state of the emergency shut-off valve 71. The emergency shut-off solenoid valve 72 is also located in the lines between the pilot valves 91, 92 and the reservoir 5. The (spring-loaded) emergency shut-off solenoid valve 72 is always permanently energized during operation, and as a result, the emergency shut-off valve 71 is closed and the reservoir 5 supplies the pilot valves 91, 92 with oil pressure (i.e. the check valves 81, 82 may be unlocked in this state by the pilot valves 91, 92).

The throttle 10, also called the "basic throttle," is located in the line between the opening side of the hydraulic cylinder 8 and the check valve 81 but before this line branches off to the emergency shut-off valve 71, i.e. in the immediate vicinity of the hydraulic cylinder 6. The throttle 11 is located in the line connecting the reservoir 5 to the remaining part of the apparatus. The throttle 12 is located in the line between the emergency shut-off valve 71 and the collecting and equalizing tank 1. In this case, one of the two throttles 11 or 12 should be regarded as optional (see the statements regarding the emergency shut-off function).

Optionally, the apparatus may also comprise other emergency control valves (for example an overspeed valve, etc.). These valves may be connected via the port 50, which is located in the same hydraulic line as the emergency shut-off solenoid valve 72.

Optionally, additional loads may be connected to the reservoir 5 via the port 40. The port 40 is located in the hydraulic line that connects the reservoir 5 with the remainder of the apparatus.

In the following, the modes of operation of the apparatus according to the invention are described in greater detail in the individual operating states of the hydraulic machine, and the advantages of the apparatus are explained. As the initial state, it is assumed that the reservoir 5 directly connected to the closing side of the hydraulic cylinder 6 is charged with a defined pressure and that the hydraulic cylinder 6 is in any intermediate position.

Control Operation of the Hydraulic Machine:

The pilot solenoid valves 91, 92 controlled by the controller of the hydraulic machine are kept in the de-energized state for as long as the position of the hydraulic cylinder 6 is to be maintained. As a result, the unlockable check valves 81, 82 in the control lines to the opening and closing side of the hydraulic cylinder 6 are likewise closed, and the cylinder 6 is held in position, without leakage. In this state, the variable speed drive 3 is switched off, so that no lost energy (heat) is introduced into the system. As a result, oil cooling may in principle be dispensed with, which affords the advantage of significantly better energy efficiency.

If a control process becomes necessary (for example, setpoint change or the control deviation exceeding a certain value (dead band)), the pilot valves 91 and 92 are energized via the controller, which leads to the opening of the unlockable check valves. The hydraulic cylinder may now be positioned directly over the variable speed pump drive 3. If the hydraulic cylinder 6 is designed as a synchronous cylinder, the pump assembly 2 takes in the same amount of oil on the suction side as is introduced into the cylinder on the pressure side. In this case, the two pumps in the pump assembly 2 have identical delivery volumes. If the hydraulic cylinder 6 is designed as a differential cylinder, the delivery volume ratio of the two pumps of pump assembly 2 is adapted to the differential cylinder as accurately as possible. The differential oil quantity arising during the travel of the hydraulic cylinder 6 may be compensated via the corresponding suction lines connected to the collecting and equalizing tank 1 or a small oscillating volume at the reservoir 5.

The oil volume and thus the pressure in the reservoir 5 remains largely constant and ensures that the entire system is preloaded. The permanent pressure preload of the hydraulic cylinder 6 by the reservoir 5 has the advantage that the hydraulic cylinder 6 always remains firmly clamped in the defined position, independent for example of a change in the direction of the external forces acting on the cylinder 6.

After reaching the desired position, the pilot valves 91, 92 are de-energized, and as a result, the cylinder 6 may again be held in its position again without applying energy. Notably, compared to conventional systems, the reservoir volume is no longer used for control purposes, as this task is completely performed by the pump assembly 2. Thus the reservoir volume, and consequently the reservoir size, may be drastically reduced. This also leads to a smaller collection and equalizing tank 1, which reduces costs overall.

Emergency Shut-Off:

In order to ensure a safe shut-off of the hydraulic machine in the event of a fault, an emergency shut-off function is implemented that allows the system to be shut down without power supply (or in the event of a fault in the variable speed drive 3). In the event of an emergency shut-off, the permanently energized emergency shut-off solenoid valve 72 is de-energized and the emergency shut-off valve 71 opens. Thus, the "quasi-closed" hydraulic control circuit becomes an open circuit. The reservoir 5 is connected to the closing side of the hydraulic cylinder 6, the opening side now being discharged into the collecting and equalizing tank 1. At the same time, the pressure to the pilot valves 91, 92 is relieved, so that the unlockable check valves 81, 82 close. This reliably prevents the reservoir volume from being erroneously emptied due to a fault or leakage in the pump assembly 2, for example, so that it would no longer be available for closing.

In this open circuit, the reservoir 5 delivers a defined volume within defined pressure limits. A defined closing time may therefore be safely set with the aid of the basic throttle 10 and an additional throttle 11 or 12 connected in series. If two additional throttles 11 and 12 connected in series are actually used, this results in greater flexibility and greater robustness against, for example, a rupture in the line between the basic throttle 10 and the quick shut-off valve 71, because the additional throttling effect is distributed over two throttles, only one (12) of which fails due to the line rupture.

When the hydraulic cylinder 6 travels, a dynamic pressure is created by the basic throttle 10 against which the pump assembly 2 acts and which must therefore be kept within certain limits (required nominal pressures of the lines and components, power of the pump drive 3 etc.). The individual throttles 10, 11, 12 accordingly require an individualized design. It must be a priority, in this regard, that the greatest possible proportion of the total throttling effect, and thus the closing time, must always be realized via the basic throttle 10. One of the reasons for this is that the arrangement of the basic throttle 10 directly in the opening side of the hydraulic cylinder 6 ensures a limitation of the closing time even for example in the event of a line break on the opening control side (i.e. a break in the line between the basic throttle 10 and the pump assembly 2).

Because the reservoir 5 is arranged directly in the closing side of the cylinder 6 and acts there as a "buffer," even in the fault state in which the pump drive 3 assumes a higher speed than the defined maximum speed in the closing direction, the actuating time would be limited via the basic throttle 10. Only the pressure in the reservoir 5 would slowly increase due to an increased pump flow rate.

In order to protect the apparatus against an impermissibly high pressure, pressure relief valves 30, 31 may optionally be installed respectively on the opening and closing sides of the hydraulic cylinder 6. Clearly, the pressure relief valve 31 may also be integrated in the reservoir 5.

Reservoir Charging Function:

The filling level or system pressure of the reservoir 5 is monitored by means of appropriate level and pressure sensors. The oil volume and pressure in the reservoir 5 are kept at a defined maximum level during operation, irrespective of the position of the hydraulic cylinder 6. This level will not change or will change very little during operation if a synchronous cylinder is used (see above) or if no other external loads are connected to the reservoir 5 via the optional connection point 40.

To enable the use of differential cylinders and external loads, however, the reservoir may be charged during operation by means of the variable speed drive 3 and the electrically controlled unlockable check valves 81 and 82, independently of the position of the hydraulic cylinder 6.

For this purpose, the pilot solenoid valves 91 and 92 must be in the de-energized state, which also closes the unlockable check valves 81 and 82. The pump assembly 2 is now controlled in such a way that it pumps toward the closing side of the hydraulic cylinder 6. The position of the cylinder 6 does not change as a result, because the unlockable check valve 81 in the opening side of the hydraulic cylinder 6 is closed and therefore no oil may escape from the hydraulic cylinder 6. In the closing direction, however, the flow may pass through the check valve 82, and as a result, the pressure is increased and the reservoir 5 is "charged." The differential oil quantity required for this is drawn in by the pump assembly 2 via a corresponding line from the collecting and equalizing tank 1.

If a control process becomes necessary during charging, it takes priority over the charging process. This is not a problem from a safety standpoint, because a corresponding switching point for level and pressure monitoring ensures that there is always sufficient volume or pressure in the reservoir for the possibility of an emergency shut-off. Control movements may be carried out again immediately as a result of energizing the pilot valves 91 and 92 and controlling the variable speed drive 3.

The reservoir charging function is active during normal operation and when the hydraulic machine is idle. In this way, it is ensured that there is always the appropriate safety for a possible emergency shut-off, and that this is available as quickly as possible at startup of the hydraulic machine.

Optional Quick-Close Function:

Normally, with regard to the size, speed and output of the pumps, the pump assembly 2 is designed in such a way that the opening and closing times of the hydraulic cylinder 6 that the respective use case requires may be moved solely via the pump drive 3.

If, for example, large hydraulic cylinder volumes are available and the opening times may be considerably longer in contrast to the closing times, in order to keep the dimensions of the pump assembly 2 and the pump drive 3 as small as possible (space conditions, spare part costs, etc.), these may be designed in such a way that the hydraulic cylinder 6 may only be moved with the minimum opening time.

To then achieve a faster closing time (for example in the case of a hydropower controller during load shedding), the quick-close solenoid valve 20 is optionally provided, which is located in the same hydraulic line as the emergency shut-off solenoid valve 72. By connecting this valve 20, the reservoir volume may now be used for closing. This energizes the quick-close solenoid valve 20, opening the emergency shut-off valve 71. At the same time, the pressure supply to the pilot valves 91 and 92 is hydraulically separated, so that in the control lines, the unlockable check valves 81 and 82 also close. The pump assembly 2 may now be controlled during this process with maximum flow volume in the closing direction. The support that the pump assembly 2 provides minimizes the oil volume that is taken from the reservoir 5. This has the advantages, among others, that the reservoir 5 is emptied less frequently and that the closing time that is defined via the basic throttle 10 directly on the hydraulic cylinder 6, may be set more precisely due to the smaller spread between the initial and final pressure in the reservoir 5.

In order to be able to synchronize the machine again, for example after load shedding in a water turbine, the quick-close valve 20 is de-energized again when a defined opening is reached. At the same time, the "fine control" is now transferred back to the variable speed pump drive 3, and the machine may be synchronized once again.

In the current state, due to the closing process and the fact that not all the volume could be provided via the pump assembly 2, the reservoir was emptied by an amount less than the oil volume required to reach the corresponding hydraulic cylinder position. The pressure and the oil volume in the reservoir 5 are still high enough to allow any necessary emergency shut-off to be carried out. Nevertheless, in this situation, the reservoir 5 should be refilled as quickly as possible. Because the controller is active during and after completion of the synchronization process and after the turbine has started up again at the corresponding cylinder position, and the pump assembly 2 therefore cannot be used to charge the reservoir 5, the following procedure may be followed in this case:

When the pump assembly 2 drives the hydraulic cylinder 6 onto the corresponding opening, the pilot solenoid valves 91 and 92 are in the de-energized state. This allows the medium to flow through the check valve 81 on the opening side, while the check valve 82 on the closing side remains blocked. As a result, the oil displaced from the hydraulic cylinder 6 during drive-on is pushed directly back into the reservoir 5. The pump assembly 2 draws in the quantity of oil required for this purpose via the corresponding line from the collecting and equalizing tank 1. When the reservoir 5 has reached its nominal filling level, the corresponding check valves 81 and 82 are opened and the hydraulic cylinder 6 may be moved to its end position without further filling of the reservoir 5.

Heating Function:

When the oil temperature falls below a defined value, control is initiated via the pump assembly 2, by opening the unlockable check valves 81 and 82. This generates heat that is used to heat the system.

The invention claimed is:

1. An apparatus for controlling a hydraulic machine, the apparatus comprising:

a pump assembly having two pumps with a reversible pumping direction, said two pumps including a first pump and a second pump;

a variable-speed pump drive connected to said pump assembly and configured to drive said pumps of said pump assembly in both pumping directions;

a hydraulic cylinder having an opening side and a closing side;

an emergency shut-off valve, two unlockable check valves, and two pilot valves for unlocking said check valves;

a collecting and equalizing tank, an emergency shut-off solenoid valve, and at least two throttles;

said first pump having a first port connected via a pump line to the opening side of said hydraulic cylinder and said second pump having a first port connected via a pump line to the closing side of said hydraulic cylinder;

said first and second pumps having remaining ports each connected to said collecting and equalizing tank so that, in a drive direction of said pump drive, said first pump pumps hydraulic fluid from said collecting and equalizing tank toward said hydraulic cylinder and said second pump pumps hydraulic fluid from said hydraulic cylinder into said collecting and equalizing tank;

said collecting and equalizing tank being connected to the opening side of said hydraulic cylinder and a closing side of said hydraulic cylinder being connected to a reservoir, and said emergency shut-off valve being arranged in an equalizing line between said hydraulic cylinder and said collecting and equalizing tank;

respective unlockable check valves connected in each pump line from said pumps to said hydraulic cylinder and oriented such that in any state said check valves allow hydraulic fluid to pass towards said hydraulic cylinder;

reservoir lines connecting said reservoir respectively to said check valves and said emergency shut-off valve, to enable unlocking said check valves and closing said emergency shut-off valve, wherein said reservoir lines form, at least over a section, a single line, and said emergency shut-off solenoid valve is arranged in said section in order to be permanently energized during an operation of the hydraulic system and to be open in a supply position;

said pilot valves being arranged in separately extending sections of said reservoir lines between said reservoir and said check valves and being configured to be electrically controllable; and one throttle of said at least two throttles being disposed in the pump line to the opening side of said hydraulic cylinder in order to allow hydraulic fluid to flow through during each movement of said hydraulic cylinder, and another throttle being located either in the equalizing line between said collecting and equalizing tank and an orifice into the pump line from said pump assembly to the opening side of said hydraulic cylinder or in the reservoir line between said reservoir and the orifice into the pump line from said pump assembly to the closing side of said hydraulic cylinder.

2. The apparatus according to claim 1, wherein an additional throttle is located either in the equalizing line between said collecting and equalizing tank and the orifice into the pump line from said pump assembly to the opening side of said hydraulic cylinder, or in the reservoir line between said reservoir and the orifice into the pump line from said pump assembly to the closing side of said hydraulic cylinder, so that a throttle is located in each of these two lines.

3. The apparatus according to claim 1, further comprising two pressure relief valves respectively connected to one of the pump lines between said unlockable check valves and said hydraulic cylinder.

4. The apparatus according to claim 1, further comprising an electrically controllable solenoid valve connected in line series with said emergency shut-off valve and configured such that when electrically energized, said solenoid valve opens said emergency shut-off valve and decouples said pilot valves from said reservoir.

5. The apparatus according to claim 1, further comprising a connection point for additional emergency shut-off valves arranged in series with said emergency shut-off solenoid valve.

6. The apparatus according to claim 1, further comprising a connection point for additional hydraulic fluid loads, arranged in series from said reservoir to said hydraulic cylinder.

7. The apparatus according to claim 1, wherein said hydraulic cylinder is a synchronous cylinder, and said pumps of said pump assembly pump an equal quantity of hydraulic fluid per revolution.

8. The apparatus according to claim 1, wherein said hydraulic cylinder is a differential cylinder, and said pumps of said pump assembly pump different quantities of hydraulic fluid per revolution, and a delivery ratio is adapted to a volume ratio of said hydraulic cylinder with respect to the closing and opening sides.

* * * * *